US006966209B1

(12) United States Patent
Schulze

(10) Patent No.: US 6,966,209 B1
(45) Date of Patent: Nov. 22, 2005

(54) INTERNAL HIGH-PRESSURE DEFORMATION METHOD FOR PRODUCTION OF IN PARTICULAR BULGING AND UNDERCUT HOLLOW BODIES

(76) Inventor: Bernd Schulze, Chemnitzer Strasse 17, 09366 Niederdorf (DE)

( * ) Notice: Subject to any disclaimer, the term of this patent is extended or adjusted under 35 U.S.C. 154(b) by 0 days.

(21) Appl. No.: 09/507,453

(22) Filed: Feb. 22, 2000

(30) Foreign Application Priority Data

Feb. 19, 1999 (DE) ..... 199 07 247

(51) Int. Cl.[7] ..... B21D 22/10; B21D 26/02
(52) U.S. Cl. ..... 72/61; 72/60; 29/421.1
(58) Field of Search ..... 72/60, 61, 709, 72/342.7, 364; 29/421.1

(56) References Cited

U.S. PATENT DOCUMENTS

| | | | | |
|---|---|---|---|---|
| 2,728,317 A | * | 12/1955 | Clevenger et al. | 72/61 |
| 4,331,284 A | * | 5/1982 | Schulz et al. | 72/60 |
| 4,534,196 A | * | 8/1985 | Kiyoto et al. | 72/61 |
| 5,692,406 A | * | 12/1997 | Yasui | 72/60 |

FOREIGN PATENT DOCUMENTS

| | | |
|---|---|---|
| DE | 19651658 | 6/1998 |
| DE | 19719426 | 11/1998 |
| DE | 19732413 | 2/1999 |
| WO | 9729869 | 8/1997 |
| WO | 9824569 | 6/1998 |

* cited by examiner

*Primary Examiner*—David Jones

(57) ABSTRACT

An internal high-pressure deformation method for the production of in particular bulging out closed hollow bodies and a corresponding device are disclosed. At least two workpiece parts (1,2) are employed, wherein at least one of the two workpiece parts (1,2) preformed of cup shape and exhibits a flange, and are pressure agent sealingly pressed in the region of the flanges (1.1,1.2) in the deformation tool according to the invention such that the two work tool pieces (1,2) are together deformed by the internal high-pressure deformation method and are further processed separately or jointly after the internal high-pressure deformation. The apparatus is subdivided in tool regions (E1, E2, E3, E4) corresponding to the work piece forms to be generated and corresponding to the number of the workpiece parts (1,2), wherein the tool regions (E1, E2, E3, E4) are disposed in different planes (FIG. 2).

20 Claims, 3 Drawing Sheets

CROSS SECTION A-A

INTERNAL HIGH-PRESSURE DEFORMATION METHOD FOR PRODUCTION OF IN PARTICULAR BULGING AND UNDERCUT HOLLOW BODIES

BACKGROUND OF THE INVENTION

1. Field of the Invention

The Invention relates to an internal high-pressure deformation method for producing in particular bulging and undercut hollow bodies and an associated device and is preferably employed for the production of hollow bodies, where the hollow bodies require a large cross-sectional change during the internal high-pressure deformation.

2. Brief Description of the Background of the Invention Including Prior Art

It is known according to the patent document publication WO 98/45692 to employ correspondingly preformed starting parts for a production of tubular hollow bodies with a flange, wherein the attached and welded flange region serves for tensioning in the deformation tool. In case two starting parts are employed, then the two starting parts cannot be again separated from each other and further processed based on the welding connection in the flange region. The variety of parts produceable is limited to tubular bodies.

Cup shaped preformed starting parts are employed in an internal high-pressure deformation method according to the printed patent document WO 97/29869. The parts are bulged out according to the tool engraving over certain regions by the internal high-pressure deformation method.

The German printed patent document DE 19719426 A1 and the German printed patent document DE 19651658 A1 teach a method for the production of hollow bodies or, respectively, molded parts, wherein tool piece parts are pressure medium sealingly pressed in the region of the flange and are jointly deformed by internal high-pressure deformation, wherein the deforming is performed against two partial engravings, and wherein the partial engravings release the workpiece after the deformation. However bulged hollow bodies are not produceable with this method just as with the device according to German printed patent document DE 19732413 A1, which is subdivided in the planes disposed parallel to each other.

SUMMARY OF THE INVENTION

Purposes of the Invention

It is an object of the Invention to develop a method and a device for internal high-pressure deformation, which allows to produce a large variety of parts, in particular of bellied workpieces, wherein it is also possible to process workpiece parts generated together by internal high-pressure deformation separately or jointly after the internal high-pressure deformation and to be able to join the separately further processed tool piece parts again to a hollow body with a precise relative spatial position.

These and other objects and advantages of the present invention will become evident from the description which follows.

BRIEF DESCRIPTION OF THE INVENTION

The present invention provides that at least two workpiece parts are employed in connection with an internal high-pressure deformation method for the production of a bulging, preferably closed hollow body, wherein at least one of the two workpiece parts can be preformed like a cup and can exhibit a flange for sealing purposes. The workpiece parts are pressed pressure agent sealingly in the region of the flange in the deformation tool, are jointly formed by the internal high-pressure deforming method and after the internal high-pressure deformation method are separately or jointly further processed, wherein the deformation is performed against an engraving, wherein the parts of the engraving can be moved apart from each other in intersecting axial directions after the deformation. Also more than two workpiece parts can be inserted on top of each other into a deformation tool, and can be tensioned pressure agent sealingly together in the flange region and can be deformed.

A relative motion of the workpiece parts is allowed during the pressure agent sealingly pressing together of the workpiece parts in the flange region, in order to allow an afterflow of the material from the flange region.

A stamping can be performed for the mutual sealing and/or for positional fixing and/or for influencing the flow of the material in the region of the flange simultaneously with the pressure agent sealingly pressing together of the workpiece parts.

The internal high-pressure deformation method can comprise furnishing a first work piece part with a first flange having a first sealing face, furnishing a second work piece part with a second flange having a second sealing face, wherein the first sealing face is matching the second sealing face to deliver a sealing connection between the first flange and the second flange, disposing the first workpiece part and the second workpiece part such that the first sealing face is disposed opposite to the second sealing face, surrounding the first workpiece and the second workpiece by engraving parts forming a mold, pressing the first sealing face against the second sealing face such that the connection between the first flange and the second flange is sealing for a fluid pressure agent;

feeding pressure agent into a volume delimited by the first workpiece and by the second workpiece, deforming the first workpiece and the second workpiece jointly by internal high-pressure deformation against the engraving parts and effected by the pressure agent;

moving the parts of the engraving away from each other to allow removal of the deformed first workpiece and of the deformed second workpiece from the mold for production of a bulging out and undercut hollow body.

A third workpiece part adjoining the first flange region can be inserted into the deformation tool. The first flange can be pressed against the third flange in a pressure agent sealing way. The third work piece part together with the first work piece part and the second work piece part can be deformed. A relative motion toward each other of the first work piece part and of the second work piece part can be allowed during the pressure agent sealingly pressing in the region of the first flange and of the second flange. A stamping can be performed in the region of the first flange and of the second flange during the pressure agent sealingly pressing together of the workpiece parts for influencing a flow of the material and/or for supporting a sealing and/or for accomplishing a positional fixation between the individual workpiece parts.

A first engraving part pressing against the first flange can be moved against a second engraving part pressing against the second flange such as to generate a sealing between the first flange and the second flange. Pressure agent can be fed through a docking connection between a pressure feed and an opening in the second workpiece part.

The device for performing the internal high-pressure deformation method is subdivided according to the workpiece form to be generated and the number of the workpiece parts in different tool planes and exhibits in a closed state an enclosed engraving according to the tool piece form to be generated. Furthermore a docking system for feeding pressure agent for generating the internal high-pressure is furnished. One or several tool planes can be subdivided in different segments according to the workpiece form, wherein the different segments are movable away from the workpiece for removal from the mold in order to assure the production of bulged and undercut workpieces.

The device includes furthermore stamping elements, which generate for example stampings in the region of the flanges of the workpiece parts, wherein the stampings serve to provide a mutual fixation in position and/or a sealing of the workpiece parts.

The tool planes for inserting the workpiece and the tool planes for removing the workpiece can be coinciding or different.

The invention furnishes for the first time a solution, where very bulging and undercut hollow bodies can be produced with internal high-pressure deformation and which method assures that several workpiece parts can be produced at the same time, wherein the work piece parts can be further processed either separately or jointly. A positional fixing is advantageous in case of a separate processing of the work piece parts and these thereupon following joining of the work piece parts to form a hollow body.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
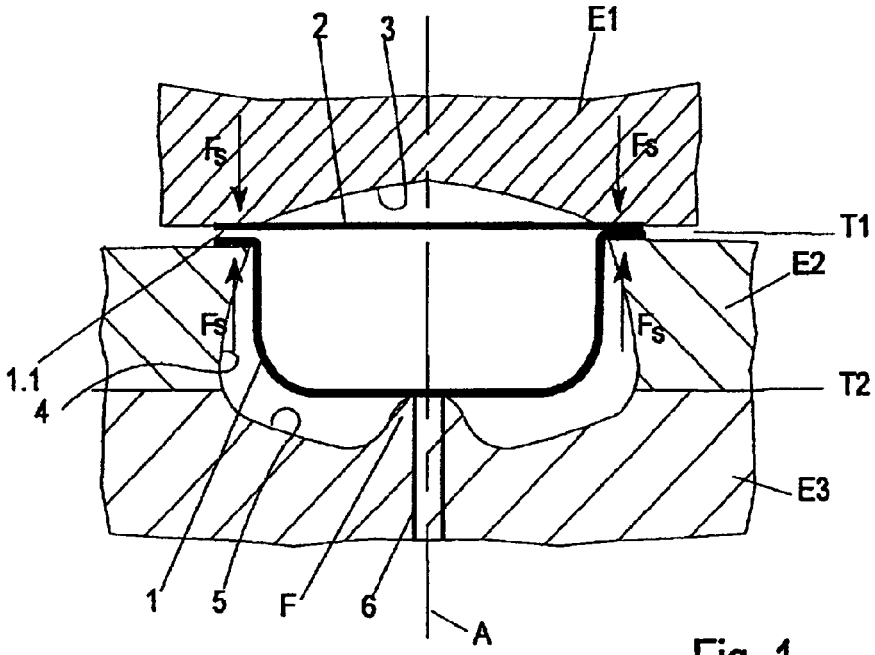
FIG. 1 is a sectional view of an internal high-pressure deformation device for a simultaneous internal high-pressure forming of a first work piece part and of a second work piece part starting position prior to pressing.

A deep drawn cup is employed as a workpiece part 1 and a planar sheet metal round blank is employed according to FIG. 1. The topological geometry corresponds to that of a pot having a cover. The device comprises three tool regions disposed in different planes, the upper region E1, the middle region E2, and the lower region E3. The upper region E1 is associated with the cover and the middle region E2 and the lower region E3 are associated with the pot part.

The top bank is furnished with a first flange and the cup is furnished with a second flange. The first flange and the second flange are laid out for superposition such that the cup and the cover blank are closed when the first flange and the second flange are pressed together. The width of the first flange is preferably equal to from about 0.8 to 1.2 times the width of the second flange. The width of the second flange can be from about 0.01 to 0.1 times the outer diameter of the cup and is preferably from about 0.02 to 0.05 of the diameter of the cup. The second flange is preferably flat and disposed in a plane, however other geometries of the second flange can be provided under the condition that the adjoining sealing surface of first flange matches the sealing surface of the second flange and the mold parts are correspondingly formed. For example, the flanges can be circular flanges and the sealing surfaces of the flanges can be conical surfaces, where the cone angles of the two flanges are substantially equal.

The first subdivision plane T1 between the first region E1 and to the second region E2 is disposed between the flanges 1.1 and 2.1 of the work piece parts 1 and 2. Preferably a first region presses against the first flange and a second region presses against a second flange such as to generate a seal between the flanges. A tensioning means is furnished which presses the first region E1 against the second region E2 in the area of the first flange and of the second flange. An engraving 3 is disposed in the upper region E1, an engraving 4 is disposed in the middle region E2, and an engraving 5 is disposed in the lower region E3, wherein the engravings together correspond to the form of the workpiece to be produced. The engravings together form an outer mold for the deforming of the cup and the cover blank. The engraving 3 forms here a mold for the sheet metal round blank (work piece part 2), the engravings 4 and 5 form the bulged out mold for the cup (starting part 1). The second subdivision plane T2 is disposed between the regions E2 and E3 in the outermost point of the engravings 4 and 5.

Figure 2:
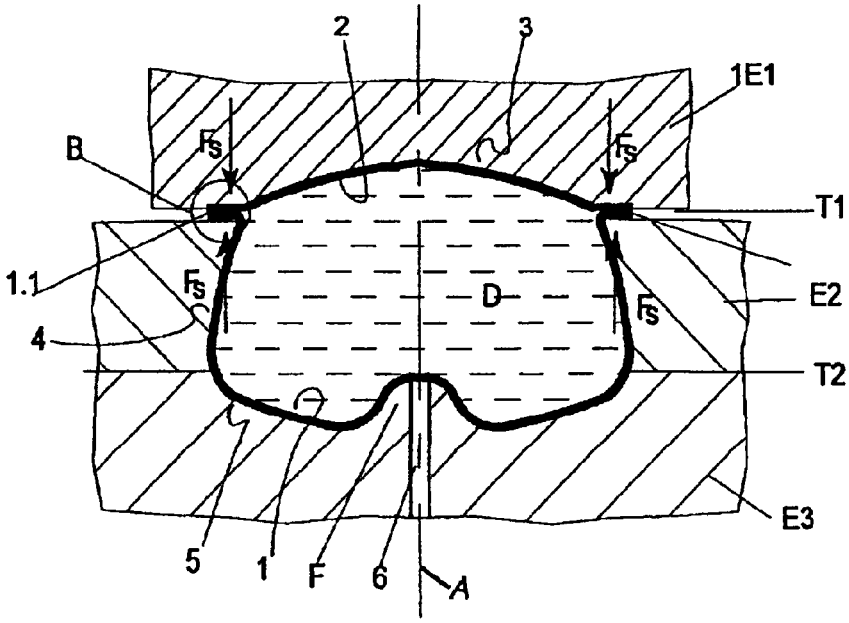
FIG. 2: is a sectional view of the internal high-pressure deformation device according to FIG. 1 according to the internal high-pressure deforming method after pressing.
Figure 3:
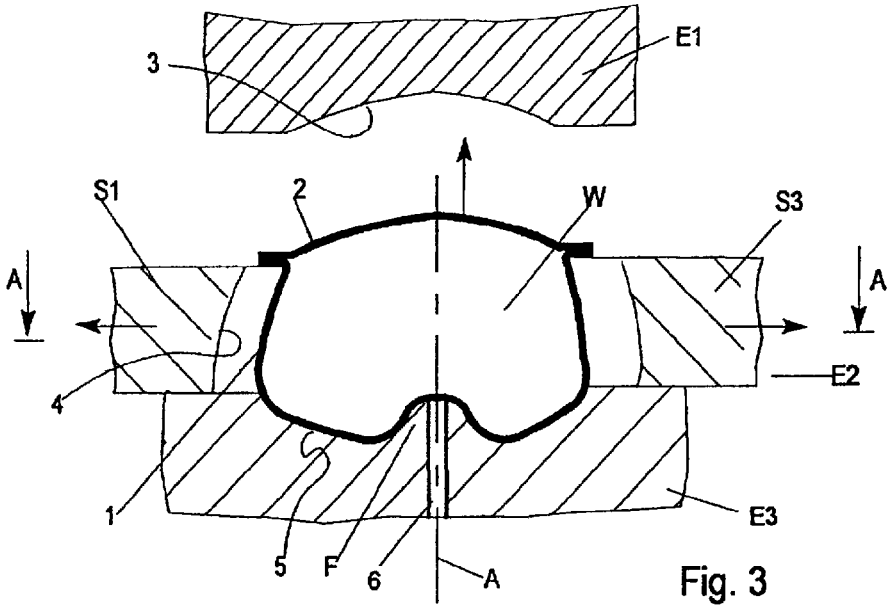
FIG. 3: is a sectional view of the opened internal high-pressure deformation device according to FIG. 1 allowing removal of the deformed workpiece.

An additional forming element F (FIGS. 1,2,3) is disposed in the engraving 5. The additional forming element F can be described as a concave section in the overall convex surface of the cup. A pressure agent feed 6 in the kind of a docking system is furnished in the region E3. Preferably a sealed connection is provided between the pressure agent feed and an opening in the wall of the cup 1. Two work piece parts 1,2 were inserted into the device according to FIG. 1 and the three regions E1, E2, E3 are closed. All regions E1, E2, E3, are tensioned relative to each other by a tensioning means and the flanges 1.1 and 2.1 are pressed together pressure agent sealingly. The two work piece parts are not connected to each other for example by welding or beading, but are only pressed to each other pressure agent sealingly based on the closure force of the close setting of the flanges.

The pressure agent D is fed through the pressure agent feed 6 and is subjected to high-pressure. The walls of the two work pieces 1 and 2 are thereby bulged out and laid at the engravings 3,4 and 5 according to FIG. 2 and thus also at the additional forming element F.

Preferably a hole is provided in the blank and the position of the hole is matched with a position of an end of the pressure agent feed such that the pressure agent ends up inside of the blank to be deformed. The connection between the pressure agent feed and the work piece part 2 can be of a docking connection type. The deformation distance can be from about 0.01 to 0.2 times the maximum diameter of the first work piece part and is preferably from about 0.02 to 0.05 times the maximum diameter of the first workpiece part.

Figure 4:
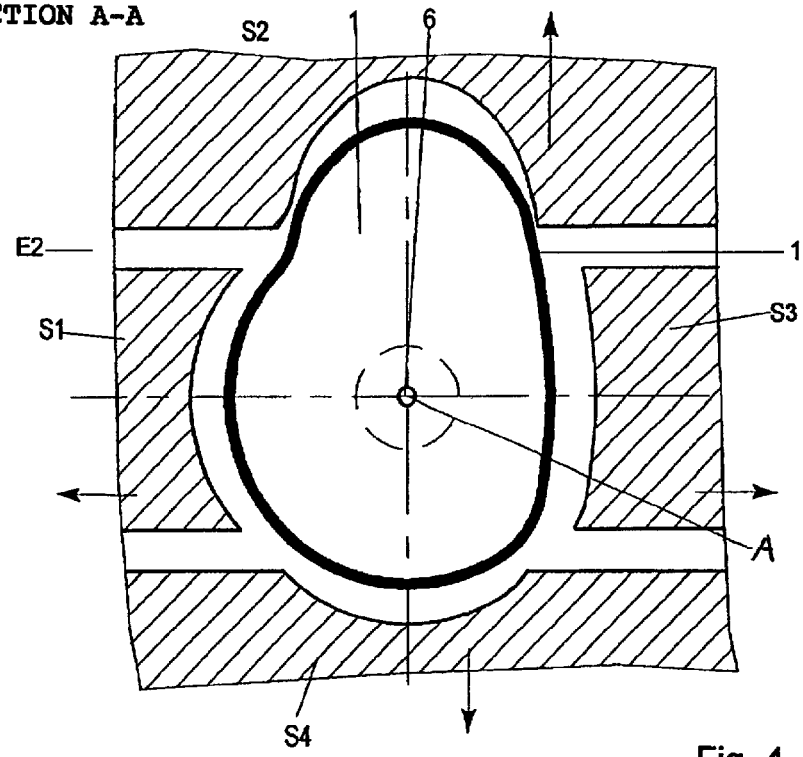
FIG. 4: is a sectional view of the embodiment of FIG. 3 along section lines 4—4 according to FIG. 3, FIG. 5: is a sectional view of detail "B" according to FIG. 2, FIG. 6: is a sectional view of a second embodiment of an internal high-pressure deformation tool for the simultaneous deforming of two starting parts furnished in the form of cups.

The device is opened after the internal high-pressure deformation. For this purpose the upper region E1 moves in the direction to the axis A of the work piece parts 1,2 vertically in upward direction according to FIGS. 3 and 4. The middle region E3 comprises four segments S1, S2, S3, S4, which are in this case opened horizontally (at a right angle relative to the axis A of the work piece parts 1,2 toward the outside, that is away from the work piece parts 1,2). The outward motion of the regions and segments is constructed such that they release the deformed workpiece without interference. The removal of the regions and segments can be performed simultaneously or successively. The internal high-pressure deformed hollow body W can be removed from the device now, wherein the internal high-pressure deformed hollow body W is composed of the two work piece parts 1 and 2. The two work piece parts 1, 2 can now be further processed either separately or jointly.

Figure 5:
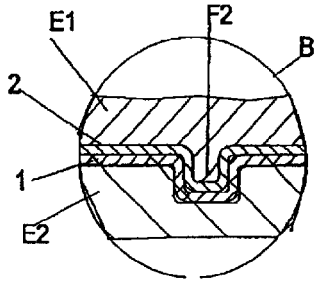

In order to achieve a precise positional location and in order to achieve a good sealing between the two work piece parts 1,2 (work piece parts W1, W2), a form element F2 can be furnished in the flanges 1.1 and 2.1 for example by starting (compare FIG. 5). The form element 2 can have preferably a rectangular or a circular segment shape. A recess 7 and a thereto corresponding stamping projection 8 are furnished for this purpose in the regions E1 and E2 directed in the direction of the flanges 1.1 and 2.1.

The two work piece parts 1 and 2 can be processed separately from each other after the internal high-pressure deformation and can in the following again be joined to form the hollow body W, wherein a precise positional location and the determination is assured between the two work piece parts 1 and 2 by the stamping. The flange cannot be employed for the sealing of other component parts, which usually is not possible in parts formed by internal high-pressure deformation based on a lack of a flange.

Based on the kind of the subdivision of the tool, it is for the first-time possible to produce such bulging out and undercut hollow bodies. The two work piece parts 1,2 can be joined to form a closed hollow body (work piece W) for example by welding of the flanges 1.1, 2.1 with or without further processing, wherein the closed hollow body in this shape has not been produceable in the past by internal high-pressure deforming.

The two starting parts can also be connected to each other permanently and non-disengageably by beading in the flange region according to a further embodiment not illustrated. There exists furthermore the possibility to manufacture a work piece with several bulged out regions, wherein the number of the regions and the subdivision planes and the number of the segments of the regions of the device have to be newly fixed.

Figure 6:
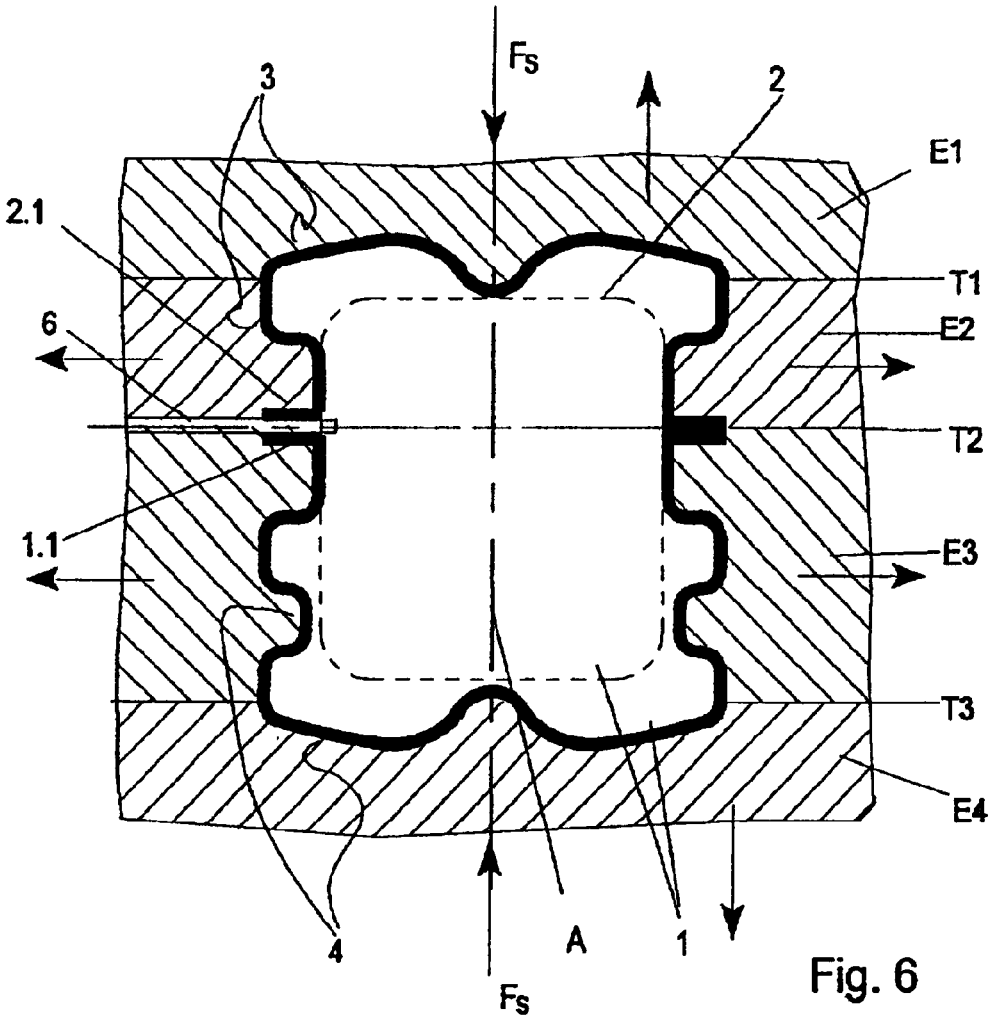

A possible variation of an embodiment according to the internal high-pressure deformation methods is illustrated in FIG. 6. Two work piece parts 1 and 2 in the form of deep drawn cups (illustrated in dashed lines in the starting position) are employed for this purpose. The two work piece parts 1 and 2 are resting with their flanges 1.1, 2.1 at each other and are pressed to each other pressure agent sealingly in the region. The pressure agent feed is performed through a docking system 6, which leads through between the two flanges 1.1, 2.1. The tool is subdivided in a total of four regions. The region E1 is disposed in the upper most position in the presentation according to FIG. 6. Then follows the region E2, where the flange 2.1 of the second cup (second tool piece 2) rests at the region E2. Following thereto the region E3 is disposed, wherein the region E3 receives the flange 1.1 of the first work piece part 1 (cup). The region E4 is disposed below the third region E3. Overall the regions E1 and E2 exhibit an engraving 4, which determines the final form of the workpiece parts 1 and 2. The subdivision plane T1 is disposed between the regions E1 and E2 and the subdivision plane T3 is disposed between the region E3 and E4 in each case in the region of the engravings 3,4 with the largest outer diameter in order to assure a removal of the workpiece from the mold. The subdivision plane T2 is disposed between the region E2 and E3, wherein the flanges 1.1 and 2.1 of the workpiece parts are also received and pressed in the subdivision plane T2. The subdivision planes T1 through T3 are disposed perpendicular to the axis A of the workpieces 1 and 2. The individual regions E1 through E4 can be subdivided additionally in several segments S. The two flanges 1.1 and 2.1 are also pressed pressure agent sealingly and the two work piece parts 1,2 are deformed by pressure impact with the pressure agent D.

The region E1 moves in arrow direction parallel to the axis A of the workpiece parts vertical upwardly and the segments S of the regions E1 through E4 also move according to the arrow direction as a right angle relative to the axis A of the workpiece parts (horizontal) away from the tool piece for removing the formed part from the mold. After the complete opening of the device, the hollow body W can be taken out of the device.

It is also possible that the segments S, S1 through S4 according to the form of the workpiece are not disposed at a right angle relative to the axis A of the workpiece parts 1,2, but are removable at a different angle away from the workpiece in addition to the embodiments illustrated here.

It will be understood that each of the elements described above, or two or more together, may also find a useful application in other types of forming configurations and molding procedures differing from the types described above.

While the invention has been illustrated and described as embodied in the context of an internal high-pressure deformation method for a production of bulging out and undercut hollow bodies, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An internal high-pressure deformation method comprising furnishing a first workpiece part with a first flange having a first sealing face;

furnishing a second workpiece part with a second flange having a second sealing face, wherein the first sealing face matches the second sealing face to deliver a sealing connection between the first flange and the second flange;

disposing the first workpiece part and the second workpiece part such that the first sealing face is disposed opposite to the second sealing face;

surrounding the first workpiece and the second workpiece by first tool region, a second tool region and a third tool region forming a mold, wherein the third tool region is subdivided into a first segment and a second segment;

pressing the first sealing face against the second sealing face such that the connection between the first flange and the second flange is sealed relative to a fluid pressurizing agent;

feeding pressurizing fluid into an area delimited by the first workpiece and by the second workpiece;

deforming the first workpiece and the second workpiece jointly by internal high-pressure against the first tool region, the second tool region and the third tool region;

moving the first tool region away from the deformed first workpiece and the deformed second workpiece;

moving the first segment away from the deformed first workpiece, the deformed second workpiece and the second segment in a direction different from the direction of pressing of the first sealing face against the second sealing face to allow removal of the deformed first workpiece and of the deformed second workpiece from the mold.

2. The internal high-pressure deformation method according to claim 1 further comprising inserting a third workpiece part adjoining the first flange region into the deformation tool; and pressing the first flange against the third flange in a pressurizing fluid sealing way;

deforming the third workpiece part together with the first workpiece part and the second workpiece part.

3. The internal high-pressure deformation method according to claim 1 further comprising allowing a relative motion toward each other of the first workpiece part and of the second workpiece part during the pressurizing fluid sealingly pressing in the region of the first flange and of the second flange.

4. The internal high-pressure deformation method according to claim 1 further comprising performing a stamping in the region of the first flange and of the second flange during the pressurizing fluid sealingly pressing together of the workpiece parts for influencing a flow of the material and/or for supporting a sealing and/or for accomplishing a positional fixation between the individual workpiece parts.

5. The internal high-pressure deformation method according to claim 1 further comprising moving a first engraving part pressing against the first flange against a second engraving part pressing against the second flange such as to generate a sealing between the first flange and the second flange.

6. The internal high-pressure deformation method according to claim 1 further comprising feeding prerssurizing fluid through a docking connection between a pressure feed and an opening in the second workpiece part.

7. An apparatus for production of bulged out and undercut hollow bodies comprising a first tool region;

a second tool region;

a third tool region, wherein the first tool region, the second tool region and the third tool region correspond to the workpiece form to be generated and to a first workpiece part and to a second workpiece part, wherein the tool regions are disposed in different planes, and wherein the third tool region is subdivided into a first segment and a second segment facing each other perpendicular to the pressing direction according to the shape of a corresponding one of the workpiece parts;

first means for flange pressing disposed at the first tool region;

second means for flange pressing disposed at the second tool region and pressing in a direction opposite to the direction of pressing of the first means of the pressing, wherein the first means for flange pressing and the second means for flange pressing are adapted to press a first flange of the first workpiece part and a second flange of the second workpiece part sealingly together, and wherein the first segment and the second segment are facing each other in a direction perpendicular to the direction of pressing of the first means for flange pressing;

means for moving the first tool region in reverse pressing direction and the first segment in another second direction and the second segment in another third direction away from a hollow body formed of the first workpiece part and of the second workpiece part for a removal of the hollow body from the mold.

8. The apparatus according to claim 7 further comprising stamping means disposed in the region of the first flange and of the second flange.

9. The apparatus according to claim 7 wherein the tool regions for insertion of the workpiece coincide with the tool planes for removal of the hollow body.

10. The apparatus according to claim 7 wherein the tool regions for insertion of the workpiece do not coincide with the tool planes for removal of the hollow body.

11. An internal high-pressure deformation method for the production of undercut hollow bodies by employing at least two workpiece parts (1,2), which two workpiece parts (1,2) are pressed by pressurizing fluid sealingly in the region of a flange (1.1,1.2) and which two workpiece parts (1,2) are deformed jointly, wherein the deforming is performed against an engraving surface, wherein the parts of the engraving surface are movable away from each other in a direction of intersecting axes.

12. The internal high-pressure deformation method according to claim 11 wherein more than two workpiece parts (1,2) adjoining each other in the flange region are inserted into the deformation tool and are pressed against each other with pressurizing fluid sealingly in the flange region and are deformed.

13. The internal high-pressure deformation method according to claim 11 wherein the work piece parts (1,2) allow a relative motion toward each other during the pressurizing fluid sealingly pressing in the flange region (1.1, 2.1).

14. The internal high-pressure deformation method according to claim 11 wherein a stamping is performed in the region of the flanges (1.1,2.1) during the pressurizing fluid sealingly pressing together of the workpiece parts (1,2) in order to influence the flow of the material and/or to support the sealing and/or to accomplish a positional fixation between the individual workpiece parts (1,2).

15. An apparatus for production of undercut hollow bodies, wherein the apparatus is subdivided into an upper tool region (E1) , a middle tool region (E2), and a lower tool region (E3) corresponding to a workpiece form to be generated and the number of workpiece parts (1, 2), wherein the upper tool is disposed in an upper plane, wherein the middle tool region is disposed in a middle plane, and wherein the lower tool region is disposed in a lower plane, wherein the middle tool region is subdivided into a first segment (S1) and a second segment (S3) according to the shape of the workpiece, wherein the workpiece is pressed by internal high pressure deformation using a liquid pressure medium, and wherein the first segment (S1) and the second segment (S3) are movable away from the hollow body (W) for removal of the hollow body (W) from the mold and further comprising means for moving the first segment from the second workpiece part in a direction disposed at an angle relative to a pressing direction performed by the first tool region and by the second tool region;

means for moving the second segment from the second workpiece part in a direction different from a pressing direction of the first tool region or of the second tool region and away from the first segment.

16. The apparatus according to claim 15 further comprising stamping elements disposed in the region of the flanges (1.1,2.1).

17. The apparatus according to claim 15 wherein the tool regions (E1, E2, E3, E4) for insertion of the workpiece coincide or do not coincide with the tool planes for removal of the work piece.

18. An apparatus for production of bulged out and undercut hollow bodies comprising a first tool region;

a second tool region;

a third tool region, wherein the third tool region is subdivided into a first segment and a second segment, wherein the first tool region corresponds to a first workpiece part, and wherein the second tool region and the first segment and the second segment correspond To a second workpiece part, wherein the tool regions are disposed on top of each other;

means for moving the first tool region in a direction away from the location of the second tool region;

means for moving the first segment from the second workpiece part in a direction disposed at an angle relative to a pressing direction performed by the first tool region and by the second tool region;

means for moving the second segment from the second workpiece part in a direction different from a pressing direction of the first tool region or of the second tool region and away from the first segment.

19. The apparatus for production of bulged out and undercut hollow bodies according to claim 18, further comprising means for moving the second tool region in a direction away from the location of the first tool region.

20. A die for production of bulged out and undercut hollow bodies comprising an upper tool region having a molding surface at its bottom side;

a middle tool region comprising a right segment having a molding surface on a left hand side and a left segment having a molding surface on a right hand side; a lower tool region having a molding surface at its top side, wherein the molding surface at the bottom side, the molding surface at the right hand side, the molding surface at the left hand side and the molding surface at the top side correspond to a workpiece form to be generated and wherein the right segment is removable toward the night side and wherein the left segment is removable toward the left hand side for allowing removal of a hollow workpiece.

* * * * *